US009087502B2

(12) United States Patent
Koike

(10) Patent No.: US 9,087,502 B2
(45) Date of Patent: Jul. 21, 2015

(54) SOUND PROCESSING APPARATUS AND SOUND PROCESSING SYSTEM

(75) Inventor: Yuji Koike, Yokohama (JP)

(73) Assignee: YAMAHA CORPORATION (JP)

( * ) Notice: Subject to any disclaimer, the term of this patent is extended or adjusted under 35 U.S.C. 154(b) by 313 days.

(21) Appl. No.: 13/112,400

(22) Filed: May 20, 2011

(65) Prior Publication Data

US 2011/0296253 A1 Dec. 1, 2011

(30) Foreign Application Priority Data

May 21, 2010 (JP) ..... 2010-117013

(51) Int. Cl.
*G10H 7/00* (2006.01)
*G10H 1/00* (2006.01)

(52) U.S. Cl.
CPC ..... *G10H 7/004* (2013.01); *G10H 1/0058* (2013.01); *G10H 2210/281* (2013.01); *G10H 2210/331* (2013.01); *G10H 2240/251* (2013.01); *G10H 2240/305* (2013.01)

(58) Field of Classification Search
None
See application file for complete search history.

(56) References Cited

U.S. PATENT DOCUMENTS 5,899,699 A * 5/1999 Kamiya ..... 709/219
6,535,772 B1 * 3/2003 Miyamori et al. ..... 700/90
8,898,062 B2 * 11/2014 Kato et al. ..... 704/266
2002/0000156 A1 * 1/2002 Nishimoto et al. ..... 84/609
2004/0011190 A1 * 1/2004 Kawashima ..... 84/645
2005/0239396 A1 * 10/2005 Kreifeldt et al. ..... 455/3.01
2007/0136480 A1 * 6/2007 Stephenson et al. ..... 709/227
2008/0250101 A1 * 10/2008 Tanaka et al. ..... 709/203
2008/0301318 A1 * 12/2008 McCue et al. ..... 709/231
2009/0019992 A1 * 1/2009 Mizuhiki et al. ..... 84/604
2009/0095145 A1 * 4/2009 Streich et al. ..... 84/609
2009/0276673 A1 * 11/2009 Kone et al. ..... 714/749
2010/0324707 A1 * 12/2010 Chao et al. ..... 700/94
2011/0144982 A1 * 6/2011 Salazar et al. ..... 704/207

FOREIGN PATENT DOCUMENTS

JP 10-177380 A 6/1998
JP 11-085148 A 3/1999

* cited by examiner

*Primary Examiner* — Ayaz Sheikh
*Assistant Examiner* — Mariela Vidal Carpio
(74) *Attorney, Agent, or Firm* — Rossi, Kimms & McDowell LLP

(57) ABSTRACT

In a structure in which a sound processing apparatus generates processed data by executing sound processing on processing object data received from a terminal apparatus and transmits it to the terminal apparatus, the number of times of communication between the terminal apparatus and the sound processing apparatus is reduced, and a delay in acquisition of the processed data by the terminal apparatus is reduced. A reception part successively receives a processing request including processing object data from the terminal apparatus. A sound processing part execute the sound processing on the processing object data to generate the processed data. A response generation part generates a response notification including the processed data as a response to the processing request. A transmission part successively transmits the response notification to the terminal apparatus.

4 Claims, 7 Drawing Sheets

SOUND PROCESSING APPARATUS AND SOUND PROCESSING SYSTEM

BACKGROUND OF THE INVENTION

1. Field of the Invention

The present invention relates to a technique to execute sound processing, such as effect imparting, on data (hereinafter referred to as "processing object data") received from a terminal apparatus through a communication network and to transmit it to the terminal apparatus.

2. Description of the Related Art

Hitherto, a technique is proposed in which a sound processing apparatus (server apparatus) to communication with a terminal apparatus executes various sound processings on behalf of the terminal apparatus (see, for example, patent document 1 and patent document 2). The sound processing apparatus executes sound processing on the processing object data received from the terminal apparatus, and transmits data (hereinafter referred to as "processed data") after the processing to the terminal apparatus. According to the above technique, the processed data generated by the sound processing can be used by the terminal apparatus without installing hardware or software necessary for the sound processing in the terminal apparatus.

[Patent document 1] JP-A-10-177380

[Patent document 2] JP-A-11-085148

A procedure based on, for example, the well-known HTTP (HyperText Transfer Protocol) can be adopted for the communication between the terminal apparatus and the sound processing apparatus. FIG. 7 is an explanatory view of the communication between the terminal apparatus and the sound processing apparatus. As shown in FIG. 7, the terminal apparatus successively transmits a processing request P (PUT request) including processing object data DA to the sound processing apparatus at a specified period T0. The sound processing apparatus receiving the processing request P transmits to the terminal apparatus a response notification RP (response) to the processing request P, and executes sound processing on the processing object data DA in the processing request P. Besides, the terminal apparatus successively transmits a transmission request G (GET request) to instruct transmission of processed data DB. The sound processing apparatus receiving the transmission request G causes the processed data DB generated by the sound processing to be included in a response notification RG and transmits it to the terminal apparatus.

However, in the technique of FIG. 7, both the processing request P and the transmission request G are transmitted from the terminal apparatus to the sound processing apparatus, and the response notification RP to the processing request P and the response notification RG to the transmission request G are transmitted from the sound processing apparatus to the terminal apparatus. Accordingly, there is a problem that the number of times of communication between the terminal apparatus and the sound processing apparatus is large.

Besides, in order to prevent a situation that the generation of the processed data DB is not yet completed at the time point when the sound processing apparatus receives the transmission request G, as shown in FIG. 7, before the transmission of the first transmission request G is started after the terminal apparatus started the transmission of the processing request P, a sufficient time $\tau$ must be secured so that it can be expected that the sound processing on the first processing object data DA is certainly completed. That is, even when the sound processing on the processing object data DA is completed at time point ta, the terminal apparatus can not acquire the processed data DB until time point tb when the time $\tau$ passes from the first processing request P (further, until the terminal apparatus receives the response notification RG to the first transmission request G after the time $\tau$ passed). Accordingly, there is also a problem that the delay time from the start of transmission of the processing request by the terminal apparatus to the acquisition of the processed data is long.

SUMMARY OF THE INVENTION

In view of the above circumstances, an object of the invention is to reduce the number of times of communication between a terminal apparatus and a sound processing apparatus and to reduce a delay in acquisition of processed data by the terminal apparatus.

In order to solve the problem, according to an aspect of the invention, a sound processing apparatus is for communicating with a terminal apparatus through a communication network and includes reception means for successively receiving a processing request including processing object data from the terminal apparatus, sound processing means for generating processed data by executing sound processing on the processing object data, response generation means for generating a response notification which is the response notification to the processing request and includes the processed data, and transmission means for successively transmitting the response notification to the terminal apparatus.

In the above structure, the response notification to the processing request for transmitting the processing object data to the sound processing apparatus includes the processed data after the sound processing of the sound processing means and is transmitted to the terminal apparatus. Thus, it is not necessary to perform the processing of transmitting the transmission request, which is exclusively used to request the processed data from the sound processing apparatus, from the terminal apparatus to the sound processing apparatus and the processing of transmitting to the terminal apparatus the response notification to the transmission request from the sound processing apparatus. Accordingly, as compared with the structure in which the processing request and the transmission request are transmitted from the terminal apparatus to the sound processing apparatus, there is a merit that the number of times of communication between the terminal apparatus and the sound processing apparatus is reduced. Besides, the processed data (response notification) is transmitted from the sound processing apparatus to the terminal apparatus without waiting for the reception of the transmission request transmitted from the terminal apparatus. Thus, as compared with the structure in which the sound processing apparatus transmits the processed data to the terminal apparatus in response to the reception of the transmission request from the terminal apparatus, there is a merit that the delay time from the start of transmission of the processing request by the terminal apparatus to the acquisition of the processed data can be reduced.

According to another aspect of the invention, the response generation means causes processed data, which is generated by the sound processing means and by the sound processing on processing object data of a first processing request received by the reception means, to be included in a response notification to a second processing request received by the reception means after reception of the first processing request. That is, when non-transmitted processed data generated by the sound processing means exists, the response generation means generates the response notification including the processed data, and when non-transmitted processed data does not exist, the response generation means generates the response notification not including processed data. According to this aspect, since the response notification is generated and transmitted without waiting for the generation of the processed data, the time from the transmission of the processing request by the terminal apparatus to the reception of the response notification to this can be shortened.

According to a still another aspect of the invention, the response generation means generates the response notification including error information indicating presence or absence of an error relating to communication of the processing request, and causes the processed data to be included in both the response notification in which the error information indicates occurrence of the error and the response notification in which the error information indicates non-occurrence of the error. According to this aspect, in addition to a case (error non-occurrence) in which the processing request is properly received, also when the error relating to the communication of the processing request occurs, the response notification to the processing request can include the processed data. Thus, there is a merit that it is possible to sufficiently ensure the chance that the terminal apparatus can acquire the processed data.

According to a still another aspect of the invention, a sound processing system uses the sound processing apparatus according to the above respective aspects. The sound processing system is the sound processing system including a sound processing apparatus and a terminal apparatus communicating with each other through a communication network, and the sound processing apparatus includes reception means for successively receiving a processing request including processing object data from the terminal apparatus, sound processing means for generating processed data by executing sound processing on the processing object data, response generation means for generating a response notification which is the response notification to the processing request and includes the processed data, and transmission means for successively transmitting the response notification to the terminal apparatus, and the terminal apparatus includes request generation means for generating the processing request, terminal side transmission means (for example, a transmission part 161 of FIG. 2) for transmitting the processing request to the sound processing apparatus, terminal side reception means (for example, a reception part 163 of FIG. 2) for receiving the response notification from the sound processing apparatus, and reception processing means for acquiring the processed data from the response notification. According to the above aspect, the same operation and effects as those of the sound processing apparatus of the invention can be realized.

Besides, the sound processing apparatus according to the above respective aspects can be realized by hardware (electronic circuit), such as a DSP (Digital Signal Processor), dedicated to the execution of sound processing, and can also be realized by cooperation of a general-purpose arithmetic processing unit, such as a CPU (Central Processing Unit), and a program (software). The program causes a computer to execute a reception process for successively receiving a processing request including processing object data from a terminal apparatus, a sound processing process for generating processed data by executing sound processing on the processing object data, a response generation process for generating a response notification which is the response notification to the processing request and includes the processed data, and a transmission process for successively transmitting the response notification to the terminal apparatus. According to the program, the same operation and effects as those of the sound processing apparatus of the invention can be realized.

The program of the invention is provided to the user in the form in which it is stored on a computer readable recording medium, and is installed in the computer. Further, the program is provided from the server apparatus in the form of delivery via the communication network, and is installed in the computer.

DETAILED DESCRIPTION OF THE INVENTION

Figure 1:
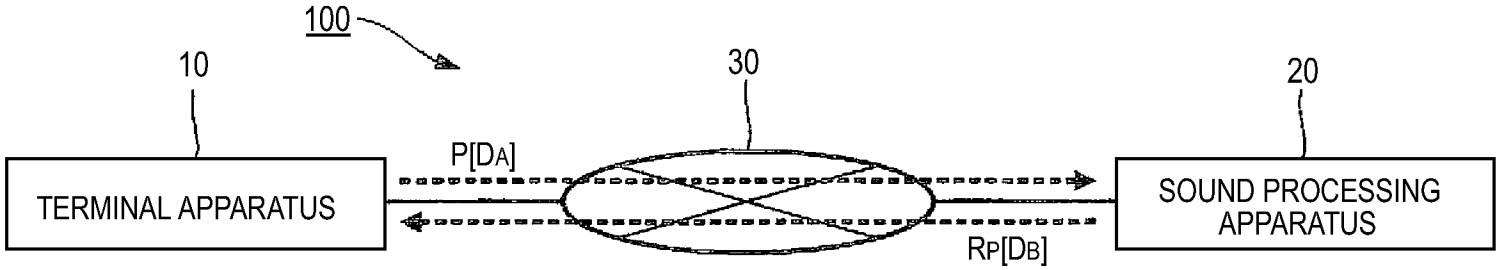
FIG. 1 is a block diagram of a sound processing system of an embodiment.

FIG. 1 is a block diagram of a sound processing system 100 of an embodiment of the invention. As shown in FIG. 1, the sound processing system 100 is a communication system including a terminal apparatus 10 and a sound processing apparatus (server apparatus) 20. The terminal apparatus 10 and the sound processing apparatus 20 communicate with each other through a communication network 30 (for example, the Internet). A communication system based on, for example, HTTP is used for the communication between the terminal apparatus 10 and the sound processing apparatus 20. Incidentally, although FIG. 1 shows only one terminal apparatus 10 for convenience, plural terminal apparatuses 10 actually communicate in parallel with the sound processing apparatus 20 through the communication network 30.

The outline of the communication performed in the sound processing system 100 will be described below. The terminal apparatus 10 successively transmits a processing request P (PUT request) including processing object data DA to the sound processing apparatus 20. The sound processing apparatus 20 executes sound processing on the processing object data DA of the processing request P received from the terminal apparatus 10, generates processed data DB, causes the processed data DB to be included in a response notification (response) RP to the processing request P received from the terminal apparatus 10 and transmits it to the terminal apparatus 10. That is, the sound processing apparatus 20 executes the sound processing (generation of the processed data DB) on the processing object data DA on behalf of the terminal apparatus. A processing (effect imparting) of imparting sound effects such as reverberation will be exemplified below as the sound processing.

Figure 2:
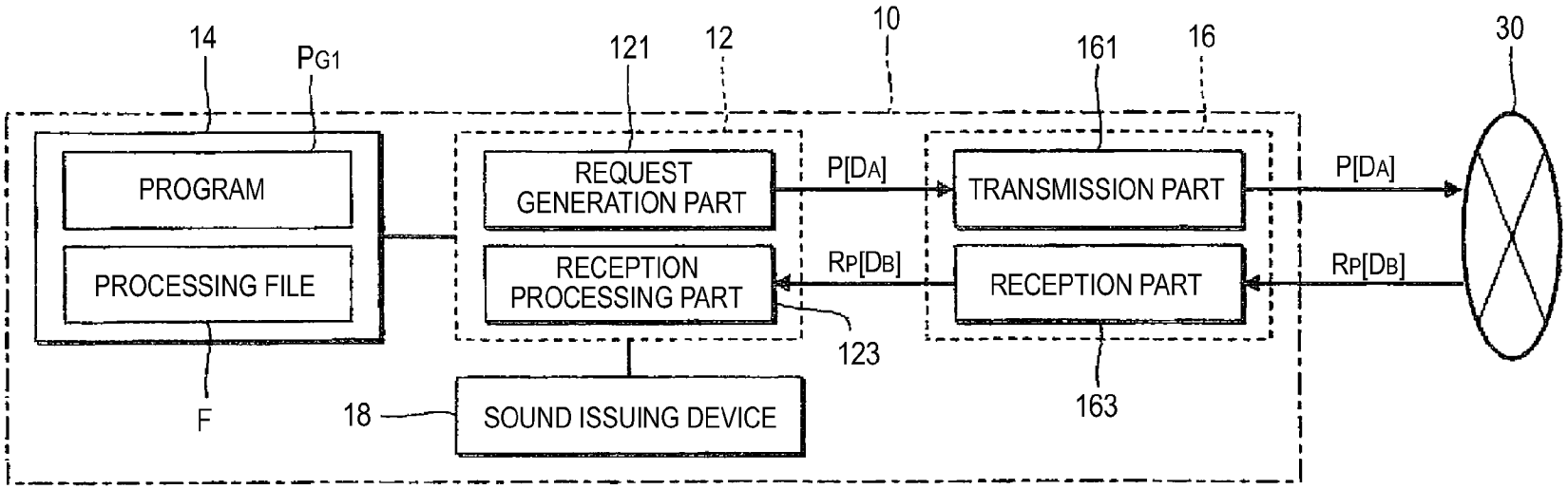
FIG. 2 is a block diagram of a terminal apparatus.

FIG. 2 is a block diagram of the terminal apparatus 10. The terminal apparatus 10 is an information terminal such as a cellular phone or a personal computer, and includes, as shown in FIG. 2, a control device 12, a storage device 14, a communication device 16 and a sound issuing device 18. The storage device 14 is formed of, for example, a semiconductor storage medium or a magnetic recording medium, and stores a program PG1 executed by the control device 12 and various data (for example, a processing file F) used by the control device 12. The processing file F is a data file as an object of the sound processing by the sound processing apparatus 20. A case where waveform data expressing temporal waveforms of a playing sound and a singing sound of apiece of music is the processing file F will be exemplified below.

The control device 12 realizes plural functions (a request generation part 121, a reception processing part 123) by executing the program PG1 stored in the storage device 14. The request generation part 121 successively generates the processing request P including the processing object data DA. The processing request P is a message to request the sound processing apparatus 20 to execute the sound processing on the processing object data DA. The request generation part 121 causes each of plural waveform data, which are obtained by dividing the one processing file F in the storage device 14, to be successively included as the processing object data DA in the processing request P.

The communication device 16 is an equipment to communicate with the sound processing apparatus 20 through the communication network 30, and includes a transmission part 161 and a reception part 163. The transmission part 161 successively transmits the processing request P generated by the request generation part 121 to the communication network 30. The reception part 163 successively receives the response notification RP generated and transmitted by the sound processing apparatus 20 from the communication network 30.

The reception processing part 123 extracts the processed data DB from the response notification RP received by the reception part 163 and successively supplies it to the sound issuing device 18. The sound issuing device 18 (for example, a speaker or a headphone) radiates the sound wave corresponding to the processed data DB supplied from the reception processing part 123. Accordingly, the user of the terminal apparatus 10 can listen to the reproduced sound obtained by executing the sound processing on the processing file F.

Figure 3:
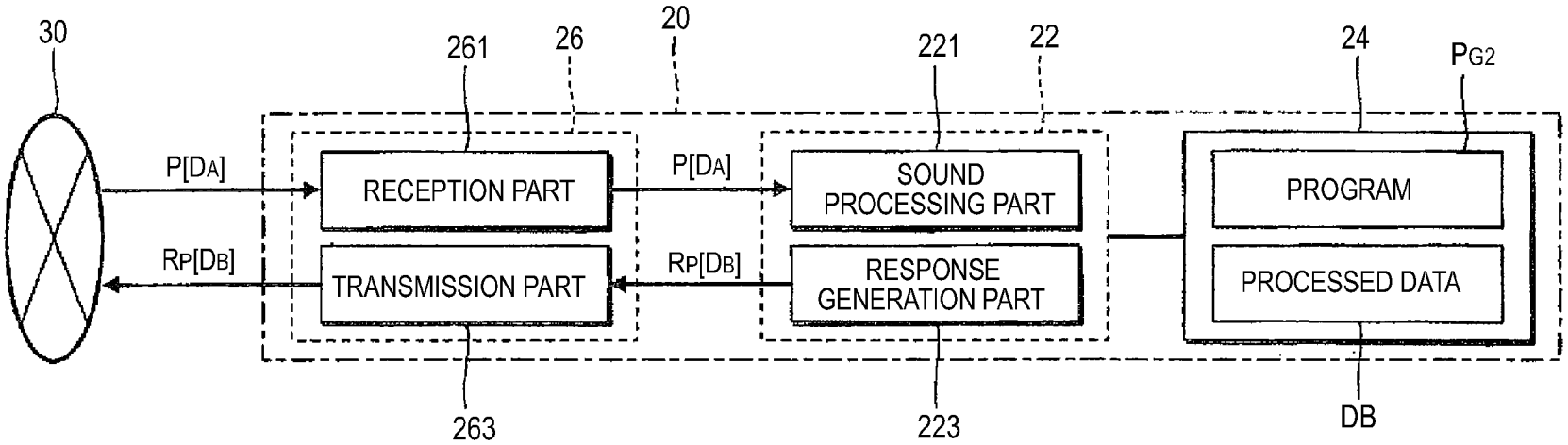
FIG. 3 is a block diagram of a sound processing apparatus.

FIG. 3 is a block diagram of the sound processing apparatus 20. As shown in FIG. 3, the sound processing apparatus 20 includes a control device 22, a storage device 24 and a communication device 26. The communication device 26 is an equipment to communicate with the terminal apparatus 10 through the communication network 30, and includes a reception part 261 and a transmission part 263. The reception part 261 successively receives the processing request P transmitted by the terminal apparatus 10 through the communication network 30. The transmission part 263 successively transmits the response notification RP generated by the sound processing apparatus 20 to the communication network 30. The storage device 24 (for example, a semiconductor storage medium or a magnetic storage medium) stores a program PG2 executed by the control device 22. The control device 22 realizes plural functions (a sound processing part 221, a response generation part 223) by executing the program PG2.

Each time the reception part 261 receives the processing request P, the sound processing part 221 generates the processed data DB by executing the sound processing on the processing object data DA in the processing request P. The processed data DB generated by the sound processing part 221 is successively stored in the storage device 24. The sound processing part 221 is realized by, for example, a VST (Virtual Studio Technology) plug-in ("VST" is registered trademark).

The response generation part 223 generates the response notification RP to the processing request P received from the terminal apparatus 10. The response notification RP is a message to notify the reception of the processing request P to the terminal apparatus 10. As shown in portion (A) to portion (D) of FIG. 4, the response notification RP includes error information E and data length L. Besides, as shown in portion (A) and portion (C) of FIG. 4, when non-transmitted processed data DB generated by the sound processing part 221 exists in the storage device 24, the processed data DB is included.

Figures 4A, 4B, 4C, 4D:
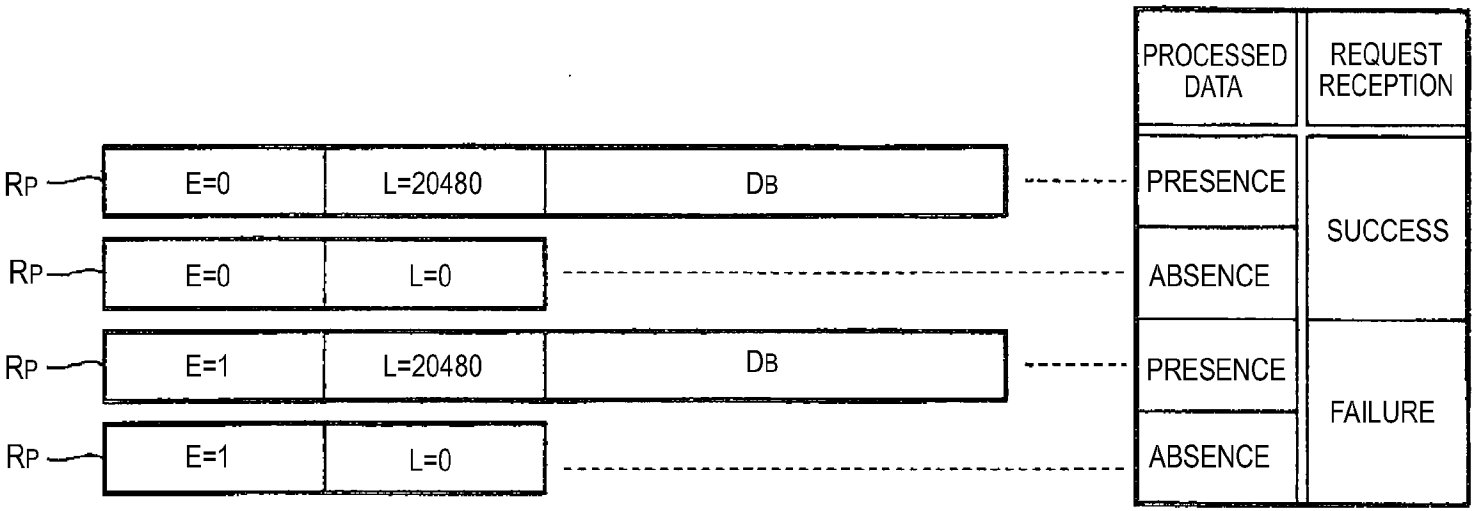
FIG. 4 is an explanatory view of a response notification.

The error information E of FIG. 4 is information (flag) indicating the presence or absence of an error relating to the communication of the processing request P (specifically, whether or not the sound processing apparatus 20 properly receives the processing request P). For example, when the size of the processing object data DA in the processing request P received by the reception part 261 is coincident with a specified value, the response generation part 223 determines that the processing request P is properly received (error non-occurrence). When the size of the processing object data DA in the processing request P is lower than the specified value, the response generation part determines that the processing request P is not properly received (error occurrence). Besides, the data length L set in the response notification RP indicates the size of the processed data DB included in the response notification RP. The data length L of the response notification RP (portion (B) or portion (D) of FIG. 4) not including the processed data DB is set to be zero. The response notification RP generated by the response generation part 223 is transmitted from the transmission part 263 of FIG. 3 to the terminal apparatus 10.

Figure 5:
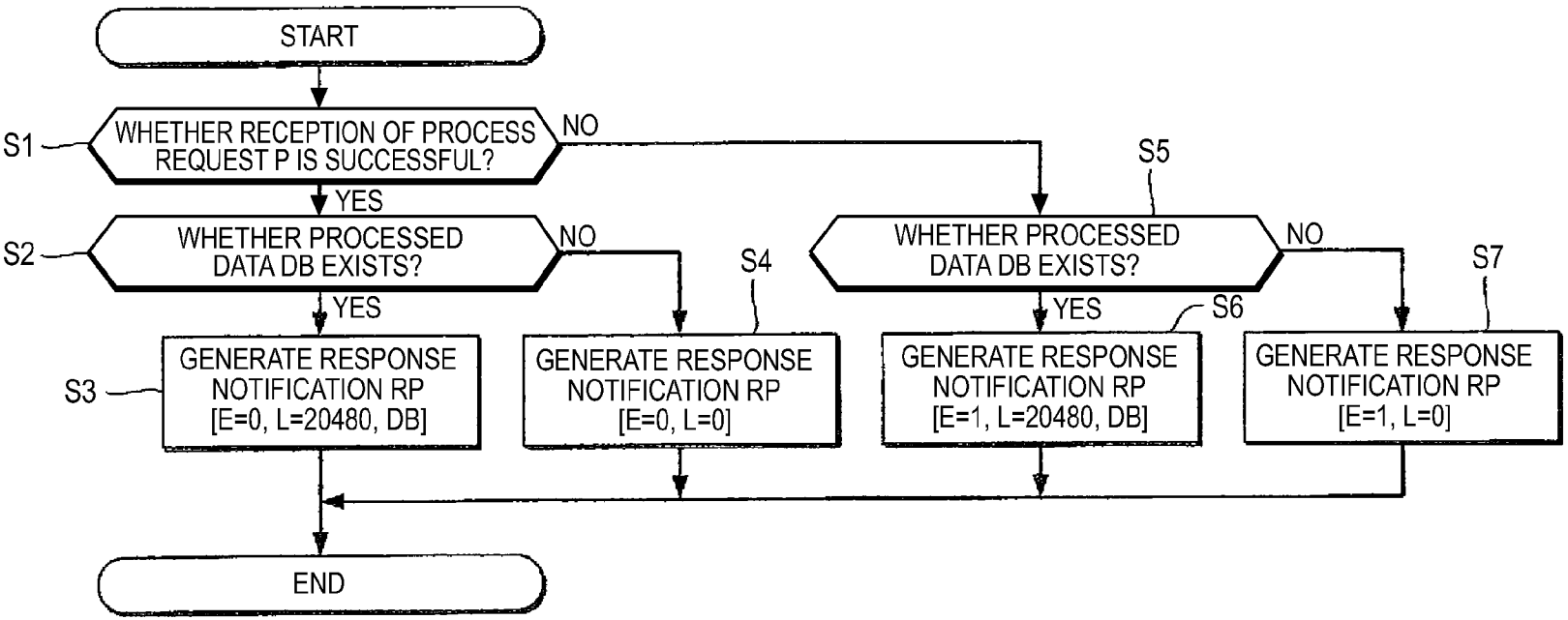
FIG. 5 is a flowchart of an operation of a response generation part.

FIG. 5 is a flowchart of the operation of the response generation part 223. Each time the reception part 261 receives the processing request P, the process of FIG. 5 is executed. When the process of FIG. 5 is started, the response generation part 223 determines whether or not the processing request P is properly received (presence or absence of an error) (S1). When the proper reception of the processing request P is successful (S1: YES), the response generation part 223 determines whether or not the non-transmitted processed data DB generated by the sound processing part 221 is stored in the storage device 24 (S2).

When the non-transmitted processed data DB exists (S2: YES), the response generation part 223 generates the response notification RP including the processed data DB (S3). When plural processed data DB exist in the storage device 24, the first processed data DB is included in the response notification RP. As shown in portion (A) of FIG. 4, in the response notification RP generated at step S3, the error information E is set to a numerical value (E=0) indicating the success of reception of the processing request P, and the data length L is set to the size (L=20480) of the processed data DB.

At the stage immediately after the communication between the terminal apparatus 10 and the sound processing apparatus 20 starts (immediately after the sound processing apparatus 20 receives the first processing request P), the processed data DB is not yet generated. Thus, the result of the determination at step S2 is negative (the processed data DB does not exist). When the processed data does not exist (S2: NO), the response generation part 223 generates the response notification RP not including the processed data DB (S4). As shown in portion (B) of FIG. 4, in the response notification RP generated at step S4, the error information E is set to a numerical value (E=0) indicating the success of reception of the processing request P, and the data length L is set to zero (the numerical value indicates that the processed data DB is not included).

On the other hand, when it is determined at step S1 that some error occurs in the reception of the processing request P (for example, the size of the processing object data DA is lower than the specified value) (S1: NO), similarly to step S2, the response generation part 223 determines whether or not the non-transmitted processed data DB exists in the storage device 24 (S5). Incidentally, when the processing request P is not properly received, the sound processing part 221 does not execute the sound processing on the processing object data DA in the processing request P.

When the non-transmitted processed data DB exists (S5: YES), the response generation part 223 generates the response notification RP including the processed data DB (the first processed data DB when plural processed data DB exist) (S6). As shown in portion (C) of FIG. 4, in the response notification RP generated at step S6, the error information E is set to a numerical value (E=1) indicating the failure of reception of the processing request P, and the data length L is set to the size (L=20480) of the processed data DB.

On the other hand, when the non-transmitted processed data DB does not exist (S5: NO), the response generation part 223 generates the response notification RP not including the processed data DB (S7). As shown in portion (D) of FIG. 4, in the response notification RP generated at step S7, the error information E is set to the numerical value (E=1) indicating the failure of reception of the processing request P, and the data length L is set to zero.

As described above, when the sound processing part 221 generates the processed data DB, the response generation part 223 cause the processed data DB to be included in the response notification RP and successively transmits it to the terminal apparatus 10 from the transmission part 263 without waiting for the request (for example, the transmission request G of FIG. 7) for the processed data DB from the terminal apparatus 10. Accordingly, the terminal apparatus 10 does not transmit the transmission request G to the sound processing apparatus 20.

When the reception part 163 receives the response notification RP transmitted by the sound processing apparatus 20 through the communication network 30, the request generation part 121 and the reception processing part 123 of the terminal apparatus 10 perform a process corresponding to the response notification RP. Specifically, when the processed data DB is included in the response notification RP, the reception processing part 123 performs a specified process (for example, sound volume adjustment or another sound processing) on the processed data DB in the response notification RP, and supplies it to the sound issuing device 18. Besides, when the error information E in the response notification RP indicates the reception success (E=0), the request generation part 121 generates the processing request P including new processing object data DA and transmits it from the transmission part 161 to the sound processing apparatus 20. On the other hand, when the error information E in the response notification RP indicates the reception failure (E=1) of the processing request P, the request generation part 121 generates the processing request P including the same processing object data DA as the last data and transmits it from the transmission part 161 to the sound processing apparatus 20 (that is, retransmission is performed).

Figure 6:
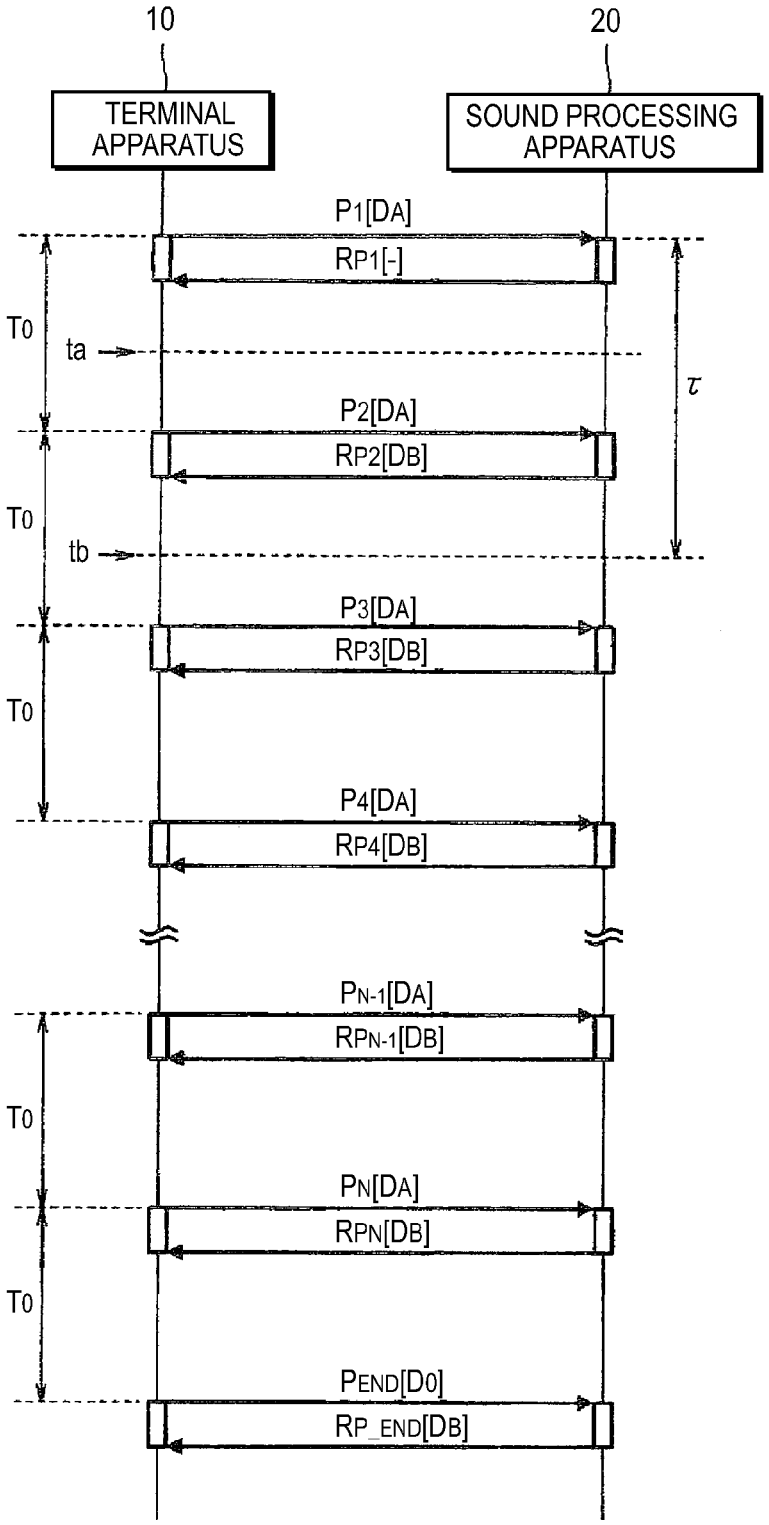
FIG. 6 is an explanatory view of a procedure of communication between a terminal apparatus and a sound processing apparatus.

FIG. 6 is an explanatory view of a procedure of communication between the terminal apparatus 10 and the sound processing apparatus 20. The terminal apparatus 10 starts transmission of the processing request P (P1, P2, . . . ) in response to the instruction from the user. The processing request P is successively transmitted to the sound processing apparatus 20 at a specified period T0. Each time the processing request Pn (n=1, 2, . . . ) is received from the terminal apparatus 10, the sound processing apparatus 20 generates the response notification RPn to the processing request Pn and transmits it to the terminal apparatus 10. Incidentally, in FIG. 6, it is supposed that the reception part 261 of the sound processing apparatus 20 properly receives all the processing requests P.

When the sound processing apparatus 20 receives the first processing request P1 from the terminal apparatus 10, the sound processing part 221 starts the sound processing on the processing object data DA in the processing request P1. Since the processed data DB is not yet generated at the time point of the processing request P1, as exemplified in portion (B) or portion (D) of FIG. 4, the response notification RP1 to the processing request P1 does not include the processed data DB.

On the other hand, at the time point when the sound processing apparatus 20 receives the processing request P2 from the terminal apparatus 10, the sound processing on the processing object data DA in the immediately preceding processing request P1 is completed. Accordingly, as shown in FIG. 6, the processed data DB generated from the processing object data DA in the immediately preceding processing request P1 is included in the response notification RP2 to the processing request P2. Hereinafter, similarly, the response notification RPn to the processing request Pn includes the processed data DB generated from the processing object data DA in the past received processing request P (for example, the immediately preceding processing request Pn−1).

When the transmission of the processing request PN including the final processing object data DA of the processing file F is completed, as shown in FIG. 6, the request generation part 121 of the terminal apparatus 10 successively transmits the processing request P (hereinafter referred to as "end request PEND") including the dummy data D0 to the sound processing apparatus 20 at the period T0 subsequently to the processing request PN. The dummy data D0 is, for example, a series of plural zero data.

The processed data DB generated from the processing object data DA in the past processing request PN (that is, the final processing object data DA of the processing file F) is included in the response notification RP_END transmitted to the terminal apparatus 10 by the sound processing apparatus 20 in response to the end request PEND. When receiving the same number of processed data DB as the processing object data DA transmitted to the sound processing apparatus 20 by the processing requests P1 to PN (when receiving the response notification RP_END including the processed data DB corresponding to the final processing object data DA), the terminal apparatus 10 ends the transmission of the processing request P. That is, the terminal apparatus 10 does not receive the processed data DB corresponding to the dummy data D0.

As described above, in this embodiment, the processed data DB generated by the sound processing part 221 is included in the response notification RP to the processing request P for transmitting the processing object data DA to the sound processing apparatus 20 and is transmitted to the terminal apparatus 10. Thus, it is not necessary that the transmission request G (GET request), which is exclusively used to request the processed data DB from the sound processing apparatus 20, is transmitted from the terminal apparatus 10 to the sound processing apparatus 20. Accordingly, as compared with the technique shown in FIG. 7, there is a merit that the number of times of communication between the terminal apparatus 10 and the sound processing apparatus 20 is reduced (approximately halved).

Figure 7:
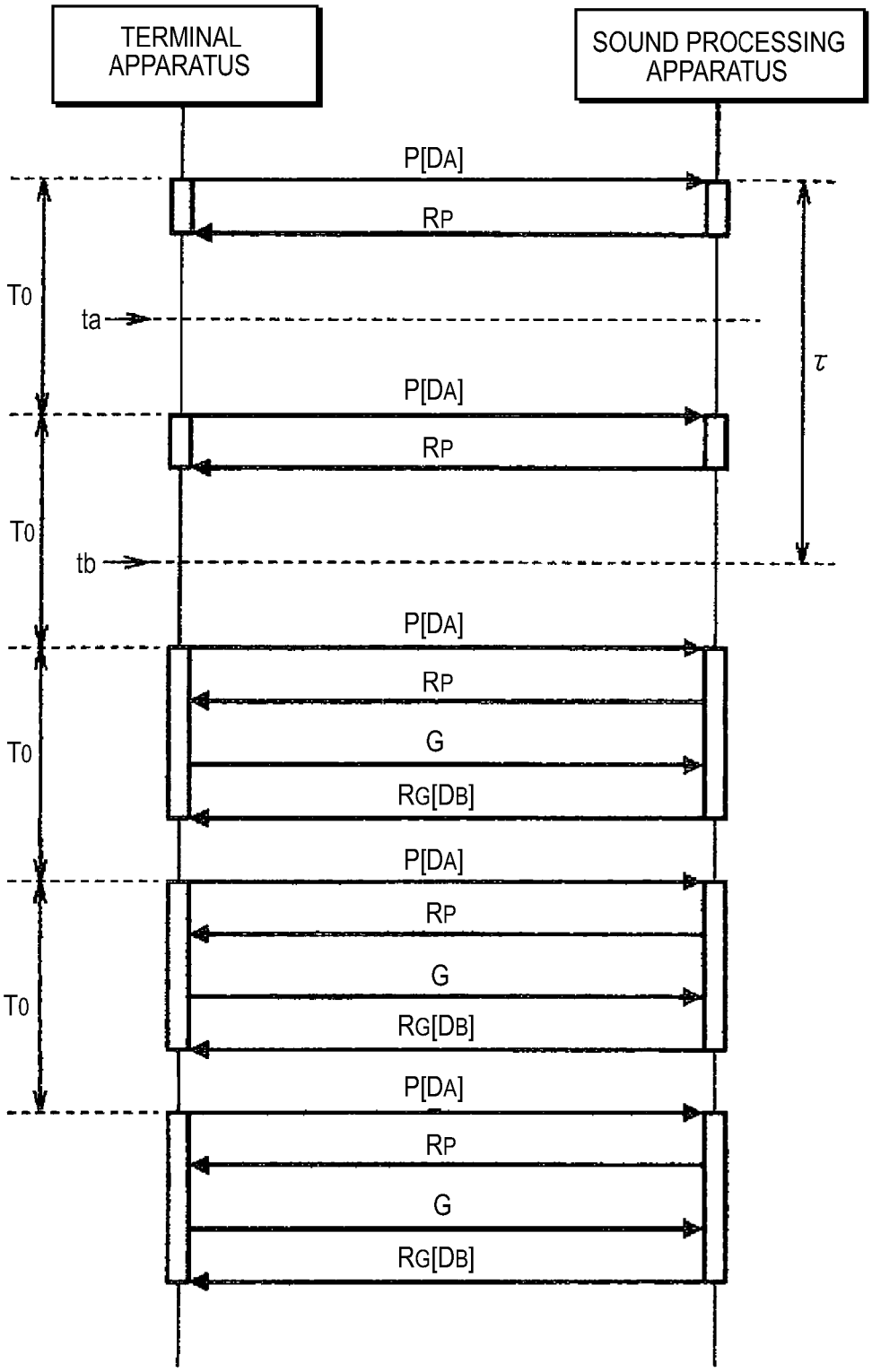
FIG. 7 is an explanatory view of a procedure of communication between a terminal apparatus and a sound processing apparatus in related art.

Besides, in the technique of FIG. 7 in which the processed data DB is transmitted from the sound processing apparatus 20 to the terminal apparatus 10 when the transmission request G from the terminal apparatus 10 is received, the transmission of the transmission request G from the terminal apparatus 10 to the sound processing apparatus 20 is started after the time point tb when the time $\tau$ (time expected to be required for completion of the sound processing) passes from the start of transmission of the processing request P. Thus, for example, in FIG. 7, even when the sound processing (generation of the processed data DB) on the processing object data DA of the first processing request P is completed at the time point ta before the transmission of the second processing request P, the terminal apparatus 10 can actually acquire the processed data DB after passing the time point tb. On the other hand, in this embodiment in which the processed data DB is included in the response notification RP, when the sound processing on the processing object data DA in the processing request P1 of FIG. 6 is completed at the time point ta, the processed data DB is included in the response notification RP2 to the processing request P2 and is transmitted to the terminal apparatus 10 without waiting for the passage of the time τ (that is, arrival of the transmission request G). Accordingly, there is a merit that the delay time from the start of transmission of the processing request P by the terminal apparatus 10 to the actual acquisition of the processed data DB (and to the reproduction of the sound wave corresponding to the processed data DB) can be shortened.

Further, the processed data DB is included in both the response notification RP (E=1) in the case where the error occurs in the reception of the processing request P and the response notification RP (E=0) in the case where the processing request P is property received. Thus, for example, as compared with the structure in which the processed data DB is included only in the response notification RP in the case where the processing request P is properly received, it is possible to sufficiently ensure the chance that the terminal apparatus 10 can acquire the processed data DB. However, the structure in which the processed data DB is not added to the response notification RP in the case where an error occurs in the reception of the processing request P can also be adopted.

B: Modified Example

The above embodiment can be variously modified. Specific modifications will be exemplified below. Two or more modifications arbitrarily selected from the following modifications can be appropriately combined.

(1) Modified Example 1

In the above embodiment, the structure (hereinafter referred to as "structure A") is exemplified in which the processed data DB generated from the processing object data DA in the past processing request P (for example, the processing request Pn−1) is included in the response notification RPn corresponding to the latest processing request Pn. However, a structure (hereinafter referred to as "structure B") can also be adopted in which the processed data DB generated from the processing object data DA in the processing request Pn is included in the response notification RPn to the processing request Pn.

In the structure A, when non-transmitted processed data DB exists in the storage device 24, the response notification RP including the processed data DB is generated. However, when non-transmitted processed data DB does not exist in the storage device 24, the response notification RP not including the processed data DB is generated. On the other hand, in the structure B, when the processed data DB does not exist in the storage device 24, the response generation part 223 stands by until the processed data DB is generated by the sound processing part 221, and generates the response notification RP including the processed data DB.

Also in the structure B, the same effects as those of the foregoing embodiment can be realized. However, in the structure B, the transmission of the response notification RPn is required to be placed on standby until the generation of the processed data DB is completed after the sound processing apparatus 20 received the processing request Pn. On the other hand, according to the structure A, when the sound processing apparatus 20 receives the processing request Pn, the response notification RPn can be transmitted to the terminal apparatus 10 irrespective of the generation of the processed data DB. Accordingly, as compared with the structure B, there is a merit that the time from the transmission of the processing request Pn by the terminal apparatus 10 to the reception of the response notification RPn can be shortened (accordingly, for example, based on the error information E of the response notification RPn, the terminal apparatus 10 can quickly recognize whether or not the sound processing apparatus 20 can properly receive the processing request Pn).

(2) Modified Example 2

In the above embodiment, the processed data DB is included in the response notification RP in units of data generated from one piece of the processing object data DA. However, a structure can also be adopted in which the processed data DB generated by the sound processing apparatus 221 are included in the response notification RP in units of a specified amount and are transmitted to the terminal apparatus 10.

(3) Modified Example 3

The content of the sound processing by the sound processing apparatus 221 is not limited to the effect imparting. For example, a processing (pitch correction) of generating the processed data DB by changing the pitch of a sound indicated by the processing object data DA can also be adopted as the sound processing.

Besides, a structure in which the sound processing part 221 generates a playing sound and a singing sound of a piece of music by sound processing can also be adopted. For example, when the sound processing apparatus 20 receives the processing object data DA (for example, MIDI (Musical Instrument Digital Interface) data), in which the pitch of each musical sound and the time point of sound production of a piece of music are specified in time series, from the terminal apparatus 10, the sound processing part 221 generates the processed data DB representing the waveform of the playing sound of the musical sound specified in time series by the processing object data DA. That is, the sound processing part 221 executes the musical sound synthesis (automatic playing) as the sound processing.

Besides, when the sound processing apparatus 20 receives the processing object data DA, in which the pitch of a singing sound and lyrics (syllable) are specified in time series, from the terminal apparatus 10, the sound processing part 221 generates the processed data DB indicating the singing sound by adjusting the phoneme corresponding to the lyrics specified by the processing object data DA to the pitch indicated by the processing object data DA and by mutually connecting them. That is, the sound processing part 221 executes the singing synthesis (voice synthesis) as the sound processing.

As is understood from the above exemplification, the sound processing of the invention includes all processings relating to the sound, and its specific form is arbitrary. The above exemplified sound processings (effect imparting, pitch correction, musical sound synthesis, singing synthesis) are typical examples included in the concept of the sound processing. Besides, the form of the processing object data DA or the processed data DB, and the content indicated by each of them are suitably selected according to the kind and content of the sound processing, and its specific form is arbitrary. For example, as is understood from the foregoing exemplification, when the effect imparting or the pitch correction is executed as the sound processing, the waveform data is preferably adopted as the processing object data DA. When the musical sound synthesis or the voice synthesis is executed as the sound processing, the time-series data (for example, MIDI data) indicating synthesis sound is preferably adopted as the processing object data DA. Incidentally, a musical element is not inevitable for the processing object data DA. For example, a structure can also be adopted in which waveform data of various sounds such as a natural sound or an artificial sound (for example, wave sound, wind sound, engine sound), which does not directly relate to music, is made the processing object data DA and the sound processing is executed.

(4) Modified Example 4

In the above embodiment, although the structure is exemplified in which the processing object data DA is previously prepared as the processing file F, a structure can also be adopted in which the processing object data DA is dynamically generated in parallel to the communication between the terminal apparatus 10 and the sound processing apparatus 20. For example, a structure can also be adopted in which the processing object data DA supplied to the terminal apparatus 10 from an input apparatus, such as an electronic instrument, according to an operation (performance) of a user is successively transmitted from the terminal apparatus 10 to the sound processing apparatus 20.

What is claimed is:

1. A sound processing apparatus for communicating with a terminal apparatus through a communication network, wherein the terminal apparatus generates a processing request for a processing file, which is divided into a plurality of waveform data, and successively transmits the plurality of waveform data, the sound processing apparatus comprising:

a communication device configured to:

successively receive the plurality of waveform data, each with the processing request from the terminal apparatus; and successively transmit a response notification to the terminal apparatus in response to each of the received plurality of waveform data;

a storage device; and a sound processing control device configured to:

successively process each of the plurality of received waveform data and store the processed data in the storage device;

generate the response notification, which includes at least error information indicating presence or absence of an error relating to a communication of the processing request, in response to the received processing request, for each received waveform data, wherein the response notification further includes the processed data and data length information indicating a size of the processed data when the processed data is stored in the storage device regardless of whether the error information includes presence or absence of an error, wherein the error information includes presence of an error when the processing request contains an error regardless of whether any processed data is stored in the storage device, and wherein the error information includes absence of an error even when the processed data for a currently received waveform data is not yet processed and stored in the storage device, as long as the communication device successfully received the processing request.

2. The sound processing apparatus according to claim 1, wherein when non-transmitted processed data is stored in the storage device, the response notification includes the non-transmitted generated processed data, and when the non-transmitted processed data is not stored in the storage device, the response notification does not include the non-transmitted processed data.

3. A sound processing system comprising:

a sound processing apparatus and a terminal apparatus configured to communicate with each other through a communication network, wherein the terminal apparatus comprises:

a terminal control device configured to generate a processing request for a processing file, which is divided into a plurality of waveform data for transmission; and a first communication device configured to:

successively transmit the plurality of waveform data each with the processing request to the sound processing apparatus;

successively receive a plurality of response notifications associated with the successively transmitted plurality of waveform data from the sound processing apparatus, wherein the terminal control device is further configured to extract the processed data from each of the successively received plurality of response notifications, wherein the sound processing apparatus includes:

a second communication device configured to:

successively receive the plurality of waveform data, each with the processing request from the terminal apparatus; and successively transmit a response notification to the terminal apparatus in response to each of the received plurality of waveform data;

a storage device; and a sound processing control device configured to:

successively process each of the plurality of received waveform data and store the processed data in the storage device; and generate the response notification, which includes at least error information indicating presence or absence of an error relating to a communication of the processing request, in response to the received processing request, for each received waveform data, wherein the response notification further includes the processed data and data length information indicating a size of the processed data when the processed data is stored in the storage device regardless of whether the error information includes presence or absence of an error, wherein the error information includes presence of an error when the processing request contains an error regardless of whether any processed data is stored in the storage device, and wherein the error information includes absence of an error even when the processed data for a currently received waveform data is not yet processed and stored in the storage device, as long as the second communication device successfully received the processing request.

4. The sound processing apparatus according to claim 3, wherein when non-transmitted processed data is stored in the storage device, the response notification includes the non-transmitted generated processed data, and when the non-transmitted processed data is not stored in the storage device, the response notification does not include the non-transmitted processed data.

* * * * *